United States Patent [19]

Wright

[11] 4,081,237

[45] Mar. 28, 1978

[54] HEARTH CONSTRUCTION AND METHOD OF MANUFACTURE

[76] Inventor: Dennis L. Wright, 9911 Jamaica Dr., Fort Wayne, Ind. 46825

[21] Appl. No.: 681,460

[22] Filed: Apr. 29, 1976

[51] Int. Cl.[2] ..... F27D 1/16

[52] U.S. Cl. ..... 432/3; 432/252; 432/261

[58] Field of Search ..... 432/3, 120, 232, 252, 432/253, 261; 266/274

[56] References Cited

U.S. PATENT DOCUMENTS

| | | | |
|---|---|---|---|
| 2,369,756 | 2/1945 | Sackerson | 432/261 |
| 3,112,920 | 12/1963 | Strate | 432/3 |

*Primary Examiner*—John J. Camby

*Attorney, Agent, or Firm*—Gust, Irish, Jeffers & Rickert

[57] ABSTRACT

A hearth construction having a plurality of sections each of which has a first plurality of parallel, stainless steel I-beams connected in spaced relation by a plurality of transverse stainless steel I-beams. The top surfaces of the longitudinal and transverse I-beams are co-planar to provide a furnace floor for supporting work loads to be heat treated. In each section there are three elongated beams with the outer beams in each section having extensions at one end thereof. The ends of the extensions are situated in the furnace vestibule and have chamfered ends to facilitate loading and unloading of the work loads. Each section has a plurality of pairs of pier plates. The pairs are longitudinally spaced along the elongated beams at a distance corresponding to pier blocks which are situated on and extend from the furnace subfloor. The spacing between the plates in each pair dimensionally conforms to the pier blocks. The sections are then installed over the pier blocks with each pair of plates engaging opposite sides of the corresponding pier block.

6 Claims, 4 Drawing Figures

HEARTH CONSTRUCTION AND METHOD OF MANUFACTURE

BACKGROUND OF THE INVENTION

1. Field of the Invention

This invention is in the field of hearth constructions, and more particularly for hearths used in high temperature metal treating furnaces.

2. Description of the Prior Art

Metal treating furnaces and hearth constructions for such furnaces for heat treating metal work loads are basic to one of the oldest known arts. In general, the hearth constructions in the art have comprised a large plurality of ceramic, heat resistant blocks. The life expectancy of these blocks is very unpredictable and may be as short as one heating cycle in a heat treating furnace. The blocks are expensive to replace. More importantly, the furnace down time while the ceramic blocks are being replaced is very costly and in some instances, the load being heat treated is lost.

SUMMARY OF THE INVENTION

A hearth construction, for use on upstanding pier blocks which are situated on a furnace subfloor, has a plurality of sections, each having a plurality of parallel, stainless steel elongated I-beams which are connected by a plurality of transverse I-beams. The spacing of the transverse I-beams coincides with the spacing of the supporting pier blocks under the longitudinal beams. On both sides of each transverse beam is a pier plate for receiving the pier block under the transverse beam in section-supporting relation. Each section is formed of three elongated beams with the outer beams having extensions at one end thereof for extending into the furnace vestibule. The extensions have chamfered ends for the loading and unloading of work loads. There are one or more hearth sections on either side of a chain guide which is mounted for driving loads into and out of the furnace area. The transverse beams are welded to and co-planar with the elongated beams. With such a construction, an extremely durable hearth is provided which affords a ventilated furnace floor resistant to the highly corrosive chemical atmosphere and high temperature cycling experienced in metal heat treating. The hearth construction of this invention outlasts conventional constructions many times over and down time and work loss are minimized. Whereas hearth constructions utilizing ceramic blocks last only as long as the weakest block, the hearth construction of this invention has a very long, reliable, life expectancy without the frailties of frangible units.

Therefore, it is an object of this invention to provide a durable hearth construction and method of manufacture which will cause a minimum down time in the furnace.

It is another object of this invention to provide a hearth construction and method of the previous object which has hearth attached members for mounting on furnace pier blocks.

It is a further object of this invention to provide a hearth construction and method of the previous objects having loading and unloading extensions integrally formed with the hearth.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF A PREFERRED EMBODIMENT

Figures 1, 2, 3, 4:
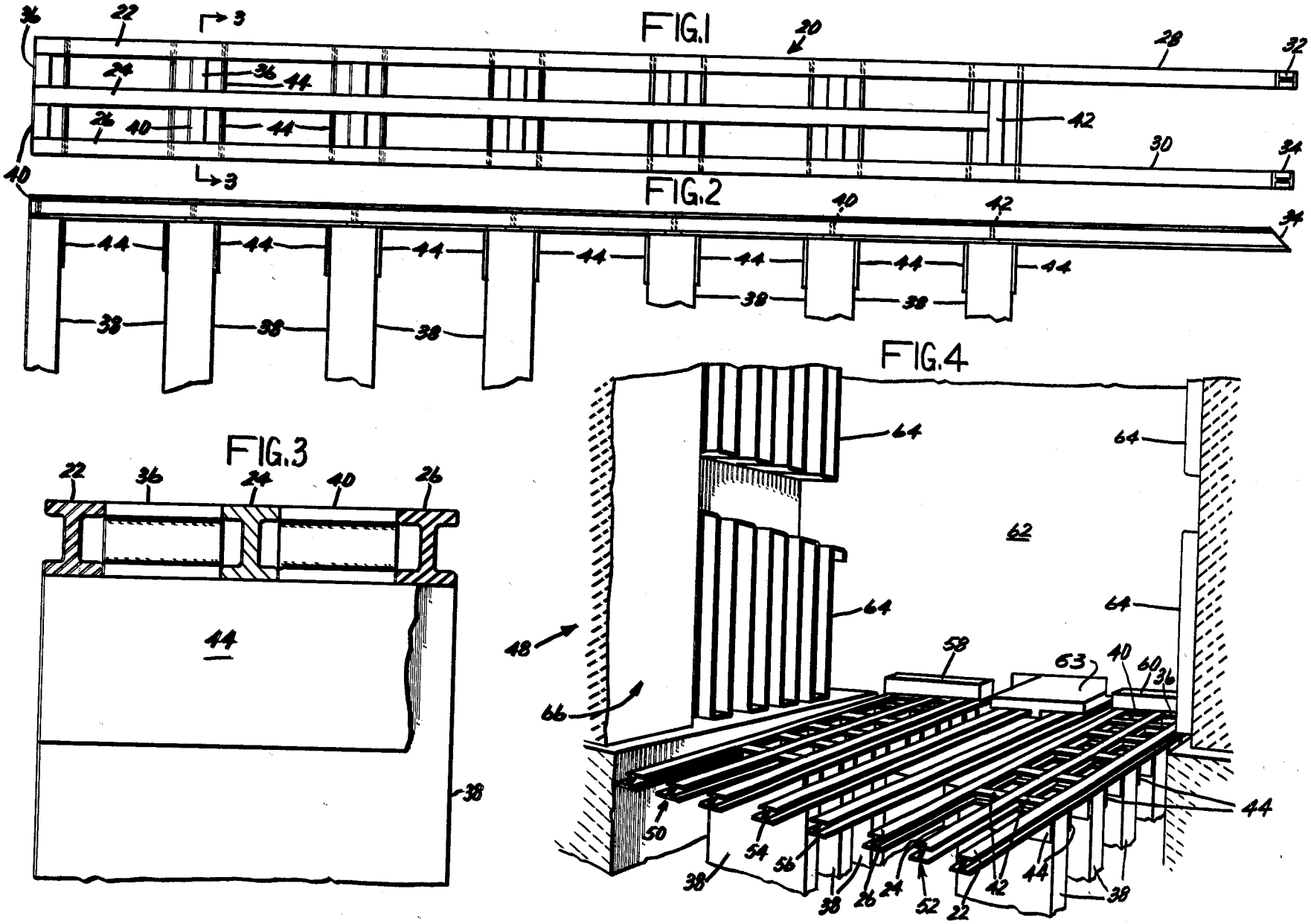
FIG. 1 is a top plan view of a preferred embodiment of this invention.
FIG. 2 is a side elevational view of the embodiment of FIG. 1 mounted on pier blocks, partially shown.
FIG. 3 is an enlarged section taken at 3—3 of FIG. 1.
FIG. 4 is a partial view in perspective showing the interior of a heat treating furnace with the hearth of this invention.

Referring to the drawing, a hearth section 20 has parallel elongated I-beams 22, 24 and 26. Outer I-beams 22 and 26 have extensions 28 and 30 respectively at one end thereof. The ends of beams 28 and 30 are chamfered at 32 and 34 respectively for loading and unloading of heat treat work loads.

Transverse I-beams 36 are welded to and transversely space beams 22 and 24 at longitudinally spaced intervals corresponding to the location of pier blocks 38 which are supported by and extend from the furnace subfloor, not shown. Blocks 38 typically are of a tile construction. Transverse I-beams 40 are welded to and transversely space beams 22, 24 and 26 at longitudinally spaced intervals corresponding to the spacing of pier blocks 38. Transverse I-beam 42 is at the end of and welded to beam 24 and is welded to and provides transverse spacing for beams 22 and 26. Beams 22, 24, 26, 36, 40 and 42 in a working embodiment are of an RA-330 stainless steel (35 nickel—15 chrome—50 steel) and are ¼ inch wall I-beams. In a working embodiment, beams 22 and 26 are 83 inches long; beam 24 is 72⅜ inches long; beams 36 and 40 are 3¼ inches long; and beam 42 is 6¾ inches long.

Pier plates 44 are fixed, as by welding, to the underside of beams 22, 24 and 26 and are longitudinally spaced on either side of beams 36 and 40 a distance corresponding to the width of pier blocks 38. Thus, a pair of pier plates is associated with each transverse beam 36 and 40 and receives with sliding clearance a pier block 38 to support section 20. In a preferred embodiment, pier plates 44 are ⅛ inch by 3 inches by 8 inches and are of the aforementioned RA-330 stainless steel material.

Referring to FIG. 4, a typical hearth construction for a furnace 48 has hearth sections 50 and 52, both sections constructed in accordance with the structure of section 20, supported on pier blocks 38 situate on and extending from a furnace subfloor, not shown. Located between sections 50 and 52 are chain guide I-beams 54 and 56 between which may be mounted a chain drive, now shown, for mechanically loading and unloading work baskets or the like. At the end of sections 50 and 52 are stop abutments 58 and 60 respectively mounted along the lower edge of furnace wall 62. Abutment 63 is mounted at the end of beams 54 and 56. On either side of furnace 48 are electrical heating elements 64 which provide the heat treating temperatures required. In the forward part of furnace 48 is vertibule 66 which provides an unheated area for loading and unloading of heat treated work loads which are slidable on sections 50 and 52 and beams 54 and 56. Additional sections may be provided as required for larger furnace work areas.

Furnace doors, not shown, may be provided between vestibule 66 and the furnace interior to retain the heat in furnace 48.

While there have been described above the principles of this invention in connection with specific apparatus, it is to be clearly understood that this description is made only by way of example and not as a limitation to the scope of the invention.

What is claimed is:

1. A hearth construction for use on and support by upstanding subfloor pier blocks comprising a first plurality of parallel, elongated transversely spaced apart beams; a second plurality of parallel transverse beams spaced longitudinally of and affixed to said first plurality of beams for adding structural support to said longitudinal beams to provide a predetermined transversely spaced relation;

said pier blocks being below said beams;

a plurality of pier plate pairs mounted transversely to said first plurality of beams and longitudinally spaced thereof in correspondence to pier block position; said plates in each pair being parallel and spaced apart a distance corresponding to the width dimension of the pier blocks to receive the pier blocks in beam supporting relation.

2. The construction of claim 1 wherein said first and second plurality of beams are stainless steel I-beams.

3. The construction of claim 2 wherein said first plurality comprises first, second and third beams; said second plurality having first members welded between said first and second beams and second members welded between said second and third beams; the upper surfaces of said first and second members and said first, second and third beams being co-planar.

4. The construction of claim 3 wherein said first and third beams in said first plurality have longitudinal extensions formed therefrom; the ends of said extensions being chamfered to facilitate loading and unloading of heat treat work loads.

5. A method of manufacturing hearths for mounting on spaced pier blocks comprising the steps of:

arranging a first plurality of parallel, spaced beams;

welding a second plurality of beams in transverse alignment to said first plurality of beams at longitudinally spaced points therealong;

welding elongate pairs of parallel pier plates in transverse alignment to said first plurality of beams, said pairs being longitudinally spaced along said first plurality corresponding to the pier block spacing, the spacing between the plates in each pair being substantially equal to the longitudinal pier block dimension.

6. The method of claim 5 including the step of arranging said second plurality in transverse alignment to said first plurality and between adjacent beams in said first plurality with the surfaces of said first plurality and said second plurality being co-planar; welding said second plurality to said first plurality.

* * * * *